United States Patent [19]

Carlson

[11] Patent Number: 4,712,487

[45] Date of Patent: Dec. 15, 1987

[54] SIDE BEARING UNIT FOR RAILROAD CAR, INCLUDING METHOD OF MAKING

[75] Inventor: Robert L. Carlson, Skokie, Ill.

[73] Assignee: Miner Enterprises, Inc., Geneva, Ill.

[21] Appl. No.: 886,931

[22] Filed: Jul. 17, 1986

Related U.S. Application Data

[63] Continuation of Ser. No. 738,506, May 28, 1985, abandoned, which is a continuation of Ser. No. 494,239, May 13, 1984, abandoned.

[51] Int. Cl.[4] ..... B61F 5/14; F16C 27/02

[52] U.S. Cl. ..... 105/199.3; 267/3; 384/423

[58] Field of Search ..... 105/199 CB, 199 R, 199.3, 105/199.1; 384/223, 420, 423; 267/3, 6, 153, 63 R

[56] References Cited

U.S. PATENT DOCUMENTS

| | | | |
|---|---|---|---|
| 128,733 | 7/1872 | King | 267/63 |
| 577,007 | 2/1897 | Cliff | 384/423 |
| 2,350,301 | 5/1944 | Cottrell | 384/423 |
| 3,343,770 | 9/1967 | Szonn | 267/153 |
| 3,556,503 | 1/1971 | van Moss, Jr. | 105/199 CB |
| 3,584,858 | 6/1971 | Beck | 267/153 |
| 3,707,927 | 1/1973 | Geyer et al. | 105/199 CB |
| 3,712,691 | 1/1973 | Cope | 105/199 CB X |
| 3,865,443 | 2/1975 | James | 105/199 CB |
| 3,910,655 | 10/1975 | Willison et al. | 105/199 CB |
| 4,090,750 | 5/1978 | Wiebe | 105/199 CB |
| 4,198,037 | 4/1980 | Anderson | 267/153 |

*Primary Examiner*—Robert B. Reeves
*Assistant Examiner*—Scott H. Werny
*Attorney, Agent, or Firm*—Wood, Dalton, Phillips, Mason & Rowe

[57] ABSTRACT

A side bearing unit for attachment to a bolster of a truck of a railroad car has a base which may be fastened to a top wall of the bolster. A housing, carried by the base, includes spaced sidewalls joined by end walls to define a cavity for an elastomeric device. A cap, positioned within the housing, is integrally joined to the elastomeric device with a top surface of the cap located above the housing for engagement with a wear plate attached to a bottom of a body of the car. During travel of the railroad car, sets of side bearing units are particularly effective in regulating independent rolling of the car body as well as impeding truck hunting.

10 Claims, 7 Drawing Figures

SIDE BEARING UNIT FOR RAILROAD CAR, INCLUDING METHOD OF MAKING

RELATED APPLICATION

This application is a continuation of my application Ser. No. 738,506, filed May 28, 1985, which is a continuation of application Ser. No. 494,239, filed May 13, 1984, both now abandoned.

BACKGROUND OF THE INVENTION

1. Field of the Invention

This invention relates to railroad cars and more particularly to side bearing units attached to a bolster of each truck of the car to regulate independent movement of a body of the car and impede truck hunting associated with higher speed travel.

2. Prior Art

For some time, side bearing units have been used to regulate relative movement between a body of a railroad car and trucks carrying ends of the car body respectively. One such side bearing unit is disclosed in U.S. Pat. No. 3,712,691 and includes a housing containing a pair of resilient cushions. The resilient cushions in turn support a cap member having a downward contoured projection which in part fits between the cushions. A top wall of the cap frictionally engages a bearing member attached to a bottom of the railroad car body.

A more recent railroad vehicle side bearing unit is disclosed in U.S. Pat. No. 3,910,655. This unit includes a housing containing a block of resilient material formed with an upper V-shaped groove. A cap fits over the block and has a central projection which fits into the groove and radiused inner facing sidewalls. When the cap is compressed by the weight of the car body, deformation of the block is in part restricted by the cap sidewalls.

A still further side bearing unit is set forth in U.S. Pat. No. 4,080,016. This unit includes a base with a housing formed by upright sidewalls and connecting end portions. Within the housing are a pair of elastomeric blocks spaced apart by a saddle block. An upper surface of the saddle block has a cusp to separate a pair of roller bearings. Each elastomeric block is formed with a relatively soft lower portion and stiff upper portion having a top surface to engage a wear plate afixed to the body of the railroad car. A fully loaded car body compresses the elastomeric blocks sufficiently so that the wear plate engages the roller bearings. This engagement reduces frictional restraints to relative movement between the bearing unit and car body.

SUMMARY OF THE INVENTION

A side bearing unit of this invention has a base which may be readily attached to a top wall of a railroad car truck bolster. A housing, attached to the base, includes a pair of spaced sidewalls connected by end walls. The walls have an inward projecting ledge forming a stop.

Within the housing is an elastomeric device having a middle portion joined by end portions. The device is made of polymer material and has non-linear compressive spring rate which increases exponentially as the device is compressed. An upper part of the middle portion of the elastomeric device is integrally joined to a cap which also fits within the housing above the wall ledge. Sides of the cap fit closely adjacent to the housing walls while a clearance space separates the housing walls and sides of the elastomeric device.

A top surface of the cap is positioned above the housing to engage a wear plate attached to a bottom of a body of the railroad car. The weight of the car body acting through the cap compresses the elastomeric device. A selective reserve space allows further travel of the cap before a bottom surface of the cap engages the housing wall ledge.

The side bearing unit of this invention offers several important advantages over known side bearing units.

A first advantage is provided by joining the cap and elastomeric device into a single integral unit. Since the cap must be replaced periodically because of wear, the elastomeric device also is replaced. The elastomeric device is subject to failure because of fatigue, environmental damage or both, yet the device cannot be readily visually inspected. Therefore, replacing both the cap and elastomeric device at the same time reduces the probability of inadvertent failure.

A second important advantage is provided by the close fit between the cap and housing and the loose fit between the elastomeric device and the housing. This arrangement confines horizontal rotational movements of the cap to minimize shearing forces acting on the elastomeric device. Since the spring rate of the elastomeric device in shear is quite low, subjecting the elastomeric device to excessive shear forces could result in failure of the elastomeric device.

A last and most important advantage provided by this side bearing unit is improved regulation of independent rolling movement of the car body with respect to the truck bolster. Such movements are dampened by resisting such with an elastomeric device having an exponentially increasing spring rate. As the degree of roll increases, the amount of resistance to such movement increases even more. To insure that the elastomeric device reacts in this desirous manner, the close fit between the cap and the housing walls promotes linear movement of the cap. The cap in turn being integrally joined to the elastomeric device applies a compressive force uniformly over a substantial length of the elastomeric device.

DESCRIPTION OF THE PREFERRED EMBODIMENT

Figure 1:
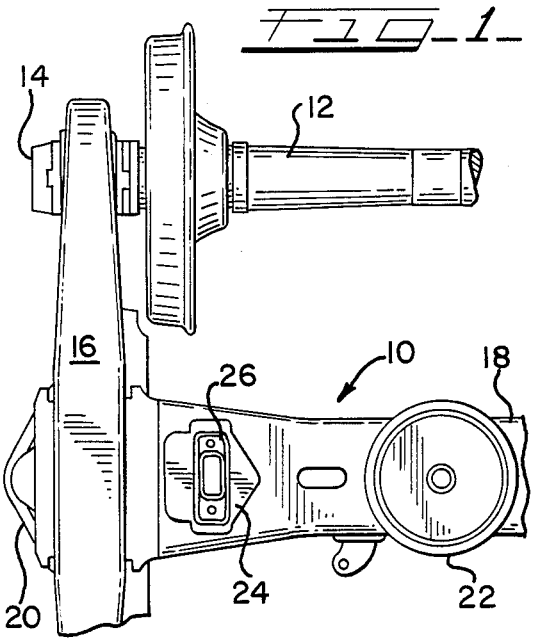
FIG. 1 is a plan view of a portion of a railroad car truck which includes a side bearing unit of this invention.

In FIG. 1 a portion of a standard railroad car truck 10 is seen generally and comprises a pair of wheelsets with a part of one such wheelset shown and designated 12. The wheelset 12, as shown, has one axle end 14 journaled in a bearing carried by a side frame 16. As is appreciated, the truck 10 includes a pair of such side frames which are connected by a transversely positioned bolster partly shown and designated 18. An end 20 of the bolster 18 is resiliently carried in a window in the side frame 16 in a known manner.

The bolster 18 further includes a center plate 22 and a pair of spaced recesses. One recess 24 is shown and contains a side bearing unit 26. The bolster center plate 22 connects with a body of the railroad car (not shown). As is recognized, the railroad car has two such trucks 10 with each supporting one end of the car body. Therefore, the railroad car has four side bearing units 26.

Figure 4:
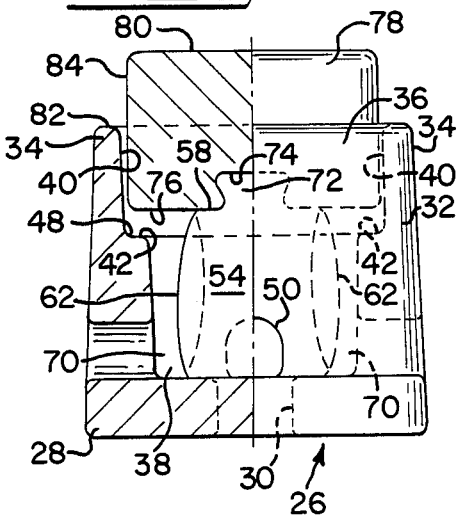
FIG. 4 is a further elevational view, partly in section, as seen generally along the line 4—4 of FIG. 2.
Figure 2:
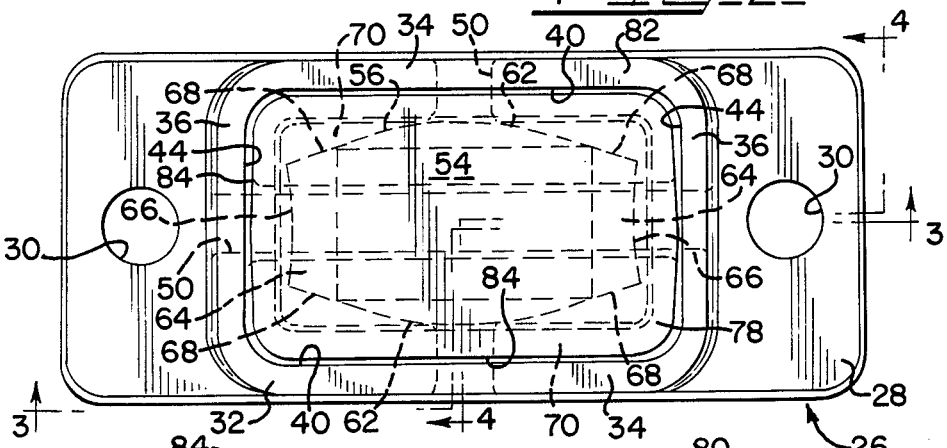
FIG. 2 is a detailed plan view of the side bearing unit shown in FIG. 1.
Figure 3:
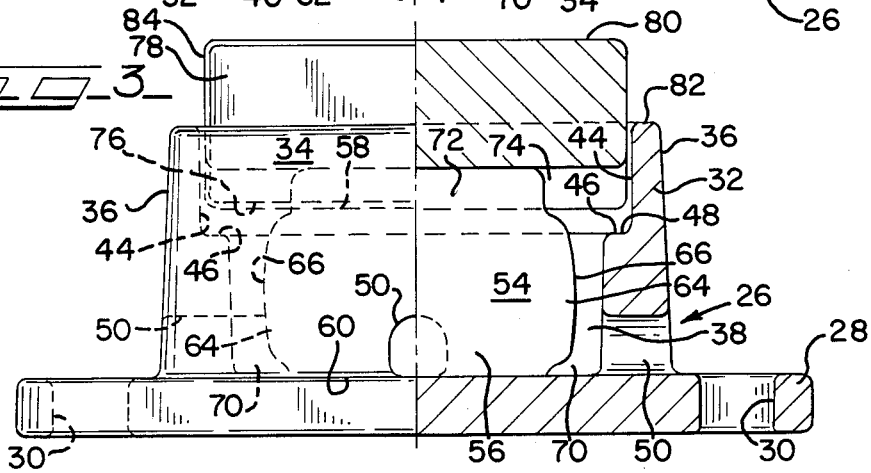
FIG. 3 is an elevational view, partly in section, as seen generally along the line 3—3 of FIG. 2.

The side bearing unit 26 is shown in detail in FIGS. 2–4 and includes a base plate 28 formed with a pair of apertures 30 to facilitate connecting the unit 26 to the truck bolster 18. Attached to the base plate 28 is a housing 32 defined by sidewalls 34 joined by end walls 36 to form an inner cavity 38. On an inner surface 40 of each sidewall 34 is a horizontal ledge 42. Likewise, on an inner surface 44 of each end wall 36 is a horizontal ledge 46. The ledges 42, 46 connect to form a continuous stop 48. Adjacent to the base plate 28 in each sidewall 34 and end wall is an opening 50.

In the housing cavity 38 is an elastomeric device 54. Uncompressed, the device 54 has a generally rectangular cross-sectional configuration through a center portion 56 of the device 54. The center portion 56 has a substantially flat top and bottom wall 58,60 and radiused sidewalls 62, see FIG. 4. Joining the elastomeric device center portion 56 are end portions 64. Each end portion 64 has an end wall 66 which is vertically convex and horizontally concave, see FIGS. 3,4. Sidewalls 68 of each end portion 64 taper outward to join the center portion sidewalls 62. A clearance space 70 separates the side and end walls 62, 66 and 68 of the elastomeric device 54 from the inner surfaces 40, 44 of the housing sidewalls 34 and end walls 36. The elastomeric device 54 further includes a key shaped strip 72 joined to the device center portion 56. The strip 72 fits in a keyway slot 74 in a bottom surface 76 of a cap 78.

The preferred material from which to make the elastomeric device 54 is a copolyester polymer sold under the trademark HYTREL. The material is first cast into a preformed block which is then annealed. The annealed preformed block is then placed together with the cap 78 and subjected to a compressive force sufficient to reduce the size of the preform by at least 30 percent of its cast size. This force is sufficient to cause a flow of material into the cap slot 74 to form the strip 72. The elastomeric device 54 and cap 78 are thus joined into an integral unit. U.S. Pat. No. 4,198,037 describes the above noted polymer material and forming process and is herein incorporated by reference to the extent applicable.

The overall height of the elastomeric device 54 and attached cap 78 is such that a top surface 80 of the cap 78 is positioned above a top edge 82 of the housing sidewalls and end walls 34, 36. In an installed state, a set of side bearing units 26 are fastened to the bolster 18 with a body of the railroad having a set of corresponding wear plates (not shown) attached to a bottom of the car body. The wear plates engage the cap top surface 80 of each unit 26 and compress each elastomeric device 54 proximately $\frac{3}{8}$ in. As so compressed, the bottom surface 76 of each cap 78 is positioned proximately $\frac{1}{4}$ in. above the housing stop 48 provided by ledges 42, 46. Note that weight of the car body is distributed equally between the center plate 22 and the set of side bearing units 26. Note further that sides 84 of the cap 78 are positioned in close proximity to the inner surface 40, 44 of the housing sidewalls 34 and end walls 36.

Figure 5:
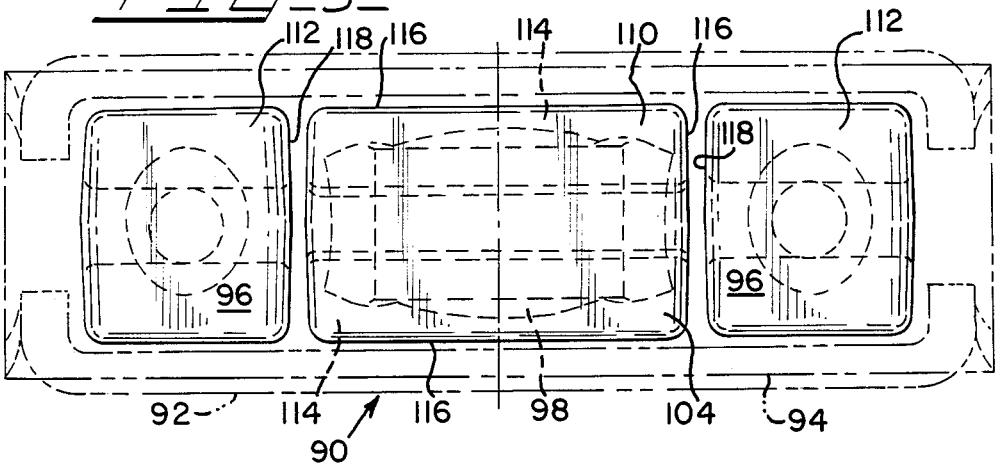
FIG. 5 is a plan view of an existing side bearing unit retrofitted with an elastomeric device and top cap similar to that shown in FIGS. 1—4.
Figure 6:
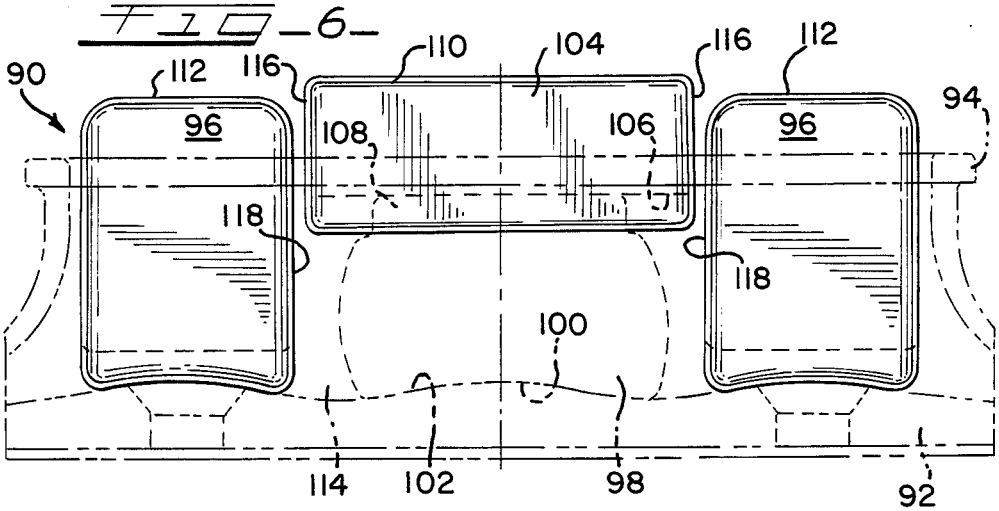
FIG. 6 is a side elevational view of the side bearing unit of FIG. 5.
Figure 7:
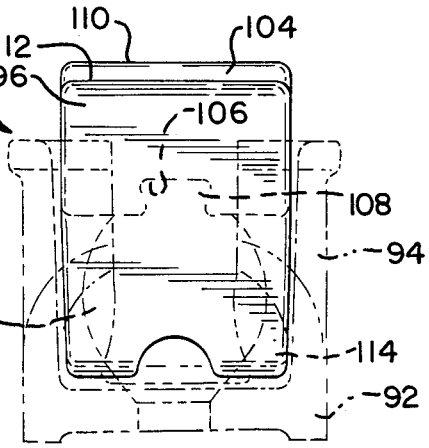
FIG. 7 is an end elevational view of the side bearing unit of FIG. 5.

In FIGS. 5, 6 and 7 is a further embodiment of a side bearing unit 90. In this case the unit 90 is formed by using a base 92 and attached housing 94 of an existing side bearing unit. This preexisting structure is depicted by broken lines. Attached to the base 92 are a pair of spaced stop blocks 96. Within the housing 94 and between the stop blocks 96 is a further elastomeric device 98 having the same general configuration as the device 54 except for a concave shaped bottom 100 which fits over a convex portion 102 in the unit base 92. Integrally joined to the elastomeric device 98 is a further cap 104. Again the cap 104 may be formed with a keyway shaped slot 106 to receive a flow of polymer material to form a complimentary key shaped strip 108.

In an uncompressed state the overall height of the elastomeric device 98 and attached cap 104 is such that a top surface 110 of the cap 104 is positioned proximately $\frac{5}{8}$ in. above a top surface 112 of the stop blocks 96. With a set of such units 90 attached to a truck bolster, for example the bolster 18, the weight of the body of the railroad car compresses the elastomeric device 98 of each unit 90. This compressive force positions the top surface 110 of the cap 102 promixately $\frac{1}{4}$ in. above the top surface 112 of the stop blocks 96. Note that like the unit 26, a clearance space 114 is provided between the unit housing 94 and elastomeric device 98 while sides 116 of the cap 104 are located closely adjacent to sides 118 of the stop blocks 96 and housing 94 to provide a relatively close fit therebetween.

During travel of the railroad car, the truck 10 tends to hunt, i.e. yaw or oscillate about a vertical axis of the truck. Such hunting is inherent since the wheelsets 12 have conical shaped rims which produce a cyclical self-centering action as the wheelsets 12 roll over a section of track. Because of the frictional engagement of the unit cap top surface, for example top surface 80 with the car body wear plate such oscillating movements are impeded. The frictional engagement between the cap top surface 80 and body wear plate is not of sufficient magnitude to prevent relative movement between the car body and truck bolster 18 which must occur if the car is to travel safely about a curved section of track.

During such travel, particularly at higher speeds over a rough section of roadbed when the car body is empty, the car body tends to roll, i.e. oscillate about a horizontal axis of the car body, independent of the bolster 18. This independent rolling action of the car body is impeded by the further compression of the elastomeric devices, for example devices 54 of the units 26. As was noted earlier, the spring rate of the device 54 is non-linear and increases exponentially as the device 54 is compressed. Thus, a much greater force is required to move the cap bottom surface 76 $\frac{1}{4}$ in. into contact with the stop ledge 48 than is required to compress the device 54 $\frac{3}{8}$ in. during initial loading. This incrementially increasing spring rate tends to dampen rolling action of the car body which is limited to $\frac{1}{2}$ in. by interference of the respective cap bottom surfaces 76 with the respective unit housing ledge stops 48.

To insure that device 54 maintains this desired spring rate characteristic, movement of the cap 78 is limited by its close fit with the housing sidewalls 34 and end walls 36. The integral joining of the cap 78 and elastomeric device 54 promotes the even distribution of forces transmitted by the car body wear plate to the cap 78 over the entire length of the device center portion 56 to compress the device 54. The clearance space 70 about the device 54 insures that these forces do not place the device 54 in shear and unduly shorten its useful life. As the device 54 is loaded and unloaded, heat is generated which may escape through the openings 50. When the cap 78 becomes sufficiently worn, the cap 78 and elastomeric device 54 are replaced as a unit insuring continued high performance. It should be appreciated that the side bearing unit 90 functions in a manner similar to the unit 26 to produce comparable results.

While the invention has been described with respect to various specific examples and embodiments, it should be understood that the invention is not limited thereto, and that it can be variously practiced within the scope of the claims.

What I claim:

1. A railroad side bearing unit comprising:

a one-piece elastomeric device having a non-linear spring rate to provide an exponentially increasing resistance to compression and prepared to fit on a base plate of said unit, said device having a center portion, said center portion having sides outwardly radiating from a vertical axis through the center of said device and tapering horizontally inward from a midpoint of said device respectively to join ends of said device, the sides of said center portion and said ends being substantially free of interference with said unit, and said center portion having a top strip connecting therewith, said ends each having an end wall vertically convex and horizontally concave and sides tapering to proximately align with and join said center portion sides, and a generally rectangular cap formed with a bottom groove to receive said elastomeric device strip and key said cap to said elastomeric device, said cap having a top surface prepared to engage with a wear plate of a railroad car body and sides to fit closely adjacent to complementary polygonal walls of said unit prevent substantial movement of the cap relative to the unit in a twisting direction and a direction transverse to said vertical axis of the elastomeric device, and to limit movement of said cap and attached elastomeric device to a direction substantially parallel to said vertical axis and promote a transfer of forces from said wear plate to said elastomeric device to evenly compress said elastomeric device over its entire middle portion to flex said device sides and ends in a shear stress minimizing manner, wherein compression of said elastomeric device results in said exponentially increasing resistance to such compression.

2. A side bearing unit for use with a railroad car, said side bearing unit comprising:

a base prepared for attachment to a bolster of a truck of said car, a housing carried on said base and including a pair of spaced apart sidewalls connected by ends walls to define a polygonal inner cavity with said walls having inner surfaces formed with a ledge, a one-piece elastomeric device carried on said base within said housing cavity, said device having a center portion, said center portion having sides outwardly radiating from a vertical axis through the center of said device and tapering horizontally inward to join ends of said device respectively, said sides and said ends of said device being separated from said housing wall inner surfaces to form a continuous clearance space therebetween, said ends each having an end wall vertically convex and horizontally concave and sides tapering to proximately align with and join said center portion sides, and a generally rectangular cap disposed in said housing and integrally keyed to said center portion of said elastomeric device, said cap having a bottom surface positioned above said wall ledge and a top surface positioned above a top edge of said walls for engagement with a wear plate attached to a bottom of a body of said railroad car and sides fitting closely adjacent said wall inner surfaces of the polygonal inner cavity of said housing to promote movement of said cap in a direction substantially parallel to said vertical axis of said elastomeric device and limit movement of said cap and attached elastomeric device in other directions to maintain said device substantially free from contact with said housing walls, wherein forces may be transferred from said railroad car body to provide movement of said cap with said nonparallel movements being selectively regulated by interference between said cap sides and said housing walls with said parallel movements compressing said device middle portion evenly to flex said device sides and ends in a minimal shear stress manner with said parallel movements limited in part by interference of said cap bottom surface with said ledge.

3. A side bearing unit as defined by claim 2 and further characterized by said elastomeric device comprising:

said center portion having a substantially flat top and bottom to engage with said cap bottom surface and said base respectively.

4. A method of making a railroad side bearing unit, comprising the steps of:

providing a generally rectangular cap with a top surface for engaging a wear plate of a railroad car;

forming a keyway in the underside of said cap;

providing a block of thermoplastic elastomer material having a selected transverse configuration including sides and ends and a selected initial free height, and forming the block with an integral key at the top thereof for fitting in the keyway of said cap;

assembling the block with the cap by locating the key of the block in the keyway of the cap to thereby form an assembly;

applying to said assembly a force sufficient to compress the block at least 30% of its initial free height to permanently reduce the height and permanently change the transverse shape of the block such that said ends each are formed with an end wall vertically convex and horizontally concave and tapering to proximately align with and join said sides and to permanently expand and lock said key of the block into the keyway of the cap;

removing said force from the assembly; and providing a housing adapted for attachment to a bolster of a truck of said car, the housing being provided with a generally rectangular cavity complementary to the generally rectangular shape of said cap and fitting closely with the cap to present substantial movement of the cap relative to the housing in a twisting direction and a direction transverse to the direction of applying said force, the sides of said permanently compressed block being separated from the housing to form a continuous clearance space therebetween.

5. The method of claim 4, including the step of locating the assembly with the permanently compressed block into a housing adapted for attachment to a bolster of a truck of said car.

6. The method of claim 4 wherein said block is provided of copolyester polymer elastomer material.

7. A side bearing unit for use with a railroad car, comprising:

a generally rectangular cap with a top surface for engaging a wear plate of a railroad car, with a keyway in the underside of the cap;

a body of thermoplastic elastomeric material having a selected transverse configuration including sides and ends and axial free height with an integral key at the top thereof for fitting in the keyway of said cap, defined by axially compressing said body by an extent equal to at least 30% of the initial free height to permanently reduce the height and permanently change the transverse shape of the body such that said ends each are formed with an end wall verticaly convex and horizontally concave and tapering to proximately align with and join said sides and to permanently expand and lock said key of the block into the keyway of the cap;

a housing adapted for attachment to a bolster of a truck of said car, including a generally rectangular housing cavity defined by surrounding side wall means, the sides of said permanently compressed body being separated from said side wall means to form a continuous clearance space therebetween, and the side wall means of said generally rectangular cavity fitting closely to the generally rectangular cap to prevent relative substantial movement of the cap relative to the housing in a twisting direction and a direction transverse to the direction of compressing said body, and to thereby limit movement of the cap and attached body in a direction substantially parallel to the direction of compressing said body.

8. The side bearing unit of claim 7, including a housing adapted for attachment to a bolster of a truck of said car, and a housing cavity for receiving said permanently compressed body.

9. The side bearing of claim 7 wherein said body is fabricated of copolyester polymer elastomer material.

10. The side bearing of claim 7 wherein said permanently compressed body has sides radiused outwardly and tapered inwardly to join top and bottom ends thereof.

* * * * *